US005400102A

United States Patent [19]

Alwitt

[11] Patent Number: 5,400,102

[45] Date of Patent: Mar. 21, 1995

[54] CAMERA CASE

[76] Inventor: Philip M. Alwitt, 351 Ninth St., Ste. 202, San Francisco, Calif. 94103

[21] Appl. No.: 7,622

[22] Filed: Jan. 21, 1993

[51] Int. Cl.[6] ..... G03B 17/02

[52] U.S. Cl. ..... 354/288; 354/81; 354/82; 224/205; 224/908

[58] Field of Search ..... 354/288, 81, 82; 224/908, 205

[56] References Cited

U.S. PATENT DOCUMENTS 2,136,357 11/1938 Darling et al. ..... 224/908
3,813,017 5/1974 Pimsleur ..... 224/205
4,649,973 3/1987 Uchin ..... 224/908
4,928,819 5/1990 Jakobsen ..... 224/908

*Primary Examiner*—Monroe H. Hayes
*Attorney, Agent, or Firm*—Kenneth M. Goldman

[57] ABSTRACT

A reversible, deformable camera carrying case is disclosed wherein the latch for closing the case is formed by two flaps that wrap around the lenspiece. This case is especially useful for holding a camera having a longer lens. A clipping device attached to the case to ensure the camera is not separated from the case is also disclosed.

10 Claims, 6 Drawing Sheets

CAMERA CASE

FIELD OF THE INVENTION

The present invention relates generally to the field of carrying cases, more particularly to a camera carrying case. The invention further relates to an invertible camera case for cameras with extra-long lenses, the case latching through two flaps that wrap around the lens.

BACKGROUND ART

Camera carrying cases are well known in the field of photographic equipment. Most effective carrying cases provide a protective shell for the camera when not in use. These cases are designed so that the camera in its case may be carried by a strap around the user's neck, and so that the case remains attached to both user and camera while the camera is in use.

These cases also provide some method for fastening the case in a closed position when the camera resides in the case. U.S. Pat. No. 4,917,241 to Hanson discloses a two-piece case having a separate covering for the lens, and fastened by Velcro. U.S. Pat. No. 4,649,973 to Uchin discloses an "ever-ready" camera case wherein a flexible case is interlocked with a camera strap to prevent case misplacement. The Uchin case is fastened shut with a zipper. U.S. Pat. No. 4,928,819 discloses an air permeable camera case, fastened shut with an adhesive such as Velcro.

U.S. Pat. No. 4,601,318 to Diegelman discloses a camera case having separate camera-enclosing and lens enclosing portions, joined by a ring assembly and fastened shut with zippers. U.S. Pat. No. 2,938,441 to Klingenstein discloses a snap-fastened camera case with a chart selector. U.S. Pat. No. 2,323,053 to Kupferschmid discloses a soft camera pouch fastened shut by zippers. West German Patent No. 1,155,321 to Croy discloses a snap-fastened camera case with a separable lens portion.

U.S. Pat. No. 5,101,974 to Alwitt discloses an invertible camera case with the latch for closing the case inherent in the material itself. However, the Alwitt case is not practical for cases for extra-long lenses that are 4.5 inches or longer. The current invention overcomes the problems inherent in the prior art by providing a flexible, invertible camera case for holding a camera having an extra-long lens.

SUMMARY OF THE INVENTION

The present invention overcomes the drawbacks of the prior art by protecting the camera with a case of flexible, deformable material. The case is held in the closed position by two flaps that wrap around the lenspiece and are fastened underneath the lenspiece. The resiliency and deformability of the material is such that one case size will fit most cameras, especially single-lens reflex (SLR) cameras. The case is also of unitary construction, in that the cover and body of the case are continuous, minimizing assembly time and costs. A clipping device attached to the case ensures that the case is never separated from the camera, and, when the camera is held by its user with a strap, that the case is never separated from the user.

It is accordingly a primary object of the present invention to provide a camera protective case of a flexible, deformable material, wherein the case is latched by two flaps that wrap around the lenspiece and are fastened underneath the lenspiece.

It is a further object of this invention to provide a camera protective case of a flexible, deformable material, wherein the case is reversible.

It is another object of this invention to provide a reversible camera protective case of a flexible material, capable of attaching to the camera and user to prevent loss.

Additional objects, advantages and novel features of the invention will be set forth in part in the description which follows, and in part will become apparent to those skilled in the art upon examination of the following, or may be learned by practice of the invention.

In one aspect of the invention, a camera protective case is provided comprising a flexible deformable hollow body having an inner and outer surface and having contours corresponding generally to the contours of a camera to be carried therein, the body having an open end adapted to receive the camera therein, the body including a front portion having a hollow lenspiece adapted to receive and cover a lens of the camera when the camera is received in the body, the body including a rear portion opposite from the lenspiece; and a flexible deformable cover extending from the rear portion, and capable of moving from a closed position in which the cover closes the open end and overlaps the front portion to an open position in which the cover opens the open end and uncovers the front portion, the cover including a top piece having left and right sides and two flaps extending from the left and right sides, the two flaps including a fastening device mounted thereon capable of maintaining the cover in a closed position. In a preferred embodiment of this invention, the flaps are fastened to each other. In another preferred embodiment, the flaps fasten to the front portion of the body.

In another aspect of the invention, the above-described camera protective case is provided, wherein the case is invertible and further comprises one or two clipping devices capable of attaching to the camera.

BRIEF DESCRIPTION OF THE DRAWINGS

FIG. 2A shows the open position while FIG. 2B shows the case closed.

FIG. 3A shows the left side of the case, and FIG. 3B shows the right side.

DETAILED DESCRIPTION OF THE INVENTION

As used herein, the term "camera" refers to a piece of photographic equipment having a generally rectangular body and a lenspiece extending outward from the front of the body.

As used herein, the term "unitary construction" or "unitary composition" refers to an object that, although it may be manufactured from one or more pieces of material, has no well-defined boundaries, so that it is impossible to determine where one portion or component of the object ends and the next begins. In the camera case of this invention, for example, the cover and body of the case are made of continuous material, and there is no distinct boundary between the two portions. The use of this term herein of course contemplates that various fasteners or clipping devices may be attached to the case.

Figure 1:
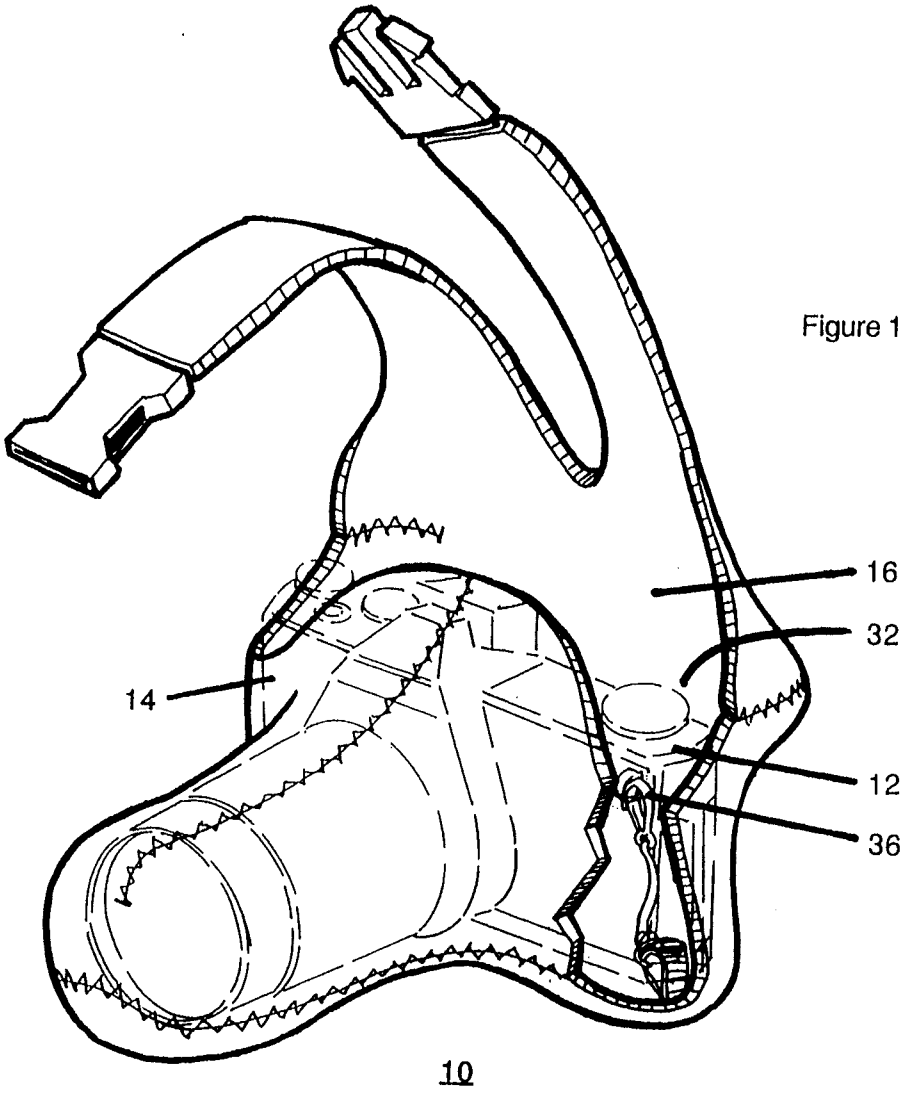
FIG. 1 is a perspective view of a camera protective case in accordance with the invention with the camera disposed in the pocket and the cover open.

In FIG. 1, the camera protective case 10 is illustrated fully protecting the camera 12 when the camera is not in use. The protective case 10 is of unitary composition and comprises main body housing 14, which provides a housing for the complete camera 12, and cover 16.

Figure 2A:
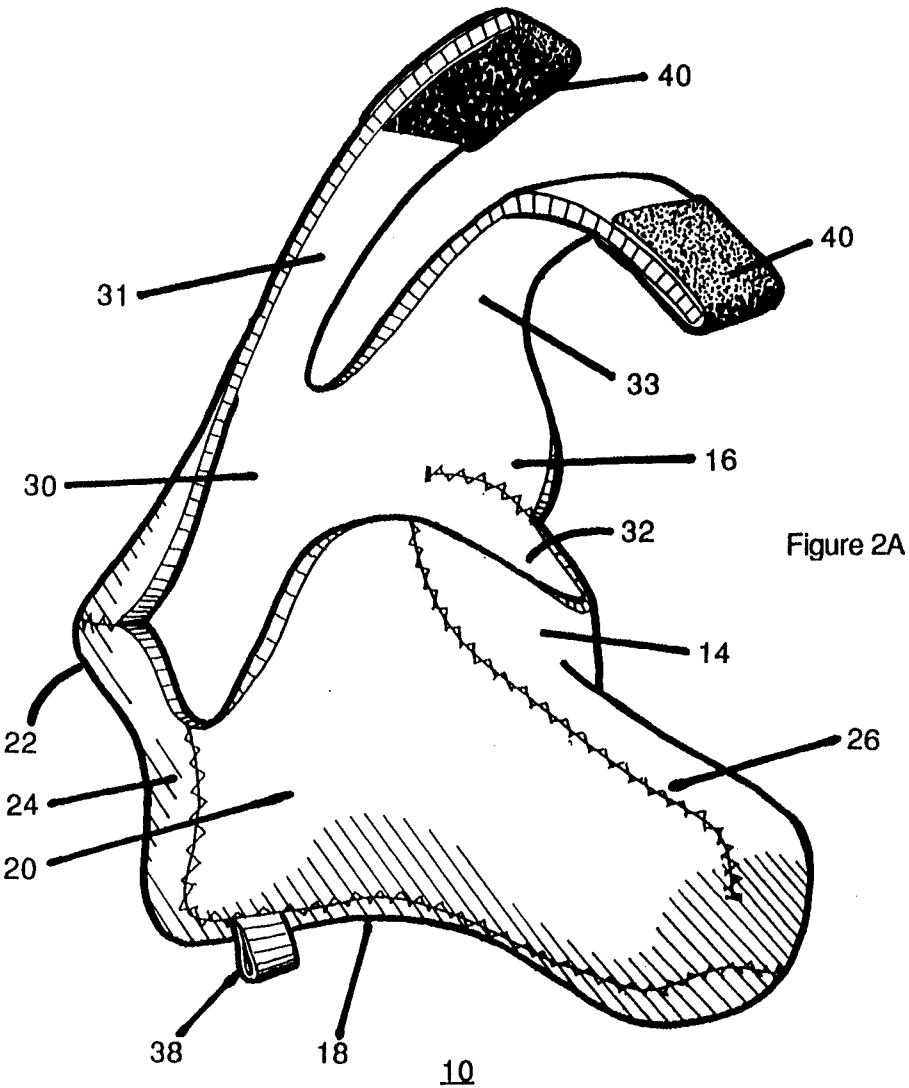
FIGS. 2A and 2B are perspective views of a camera protective case in accordance with the invention.

Main housing 14 has contours which correspond generally to the contours of a camera to be carried therein. FIG. 2A shows that although the housing is of unitary construction, it may be considered to have a floor 18, front 20 and rear panels 22, sides 24, and lenspiece 26. The housing has an open pocket 32 through which a camera may be inserted and removed from housing 14. Lenspiece 26 may be sized to house camera lenses of any size. In a preferred embodiment the camera lens is at least 4.5 inches long, although smaller lenses work as well.

Figure 2B:
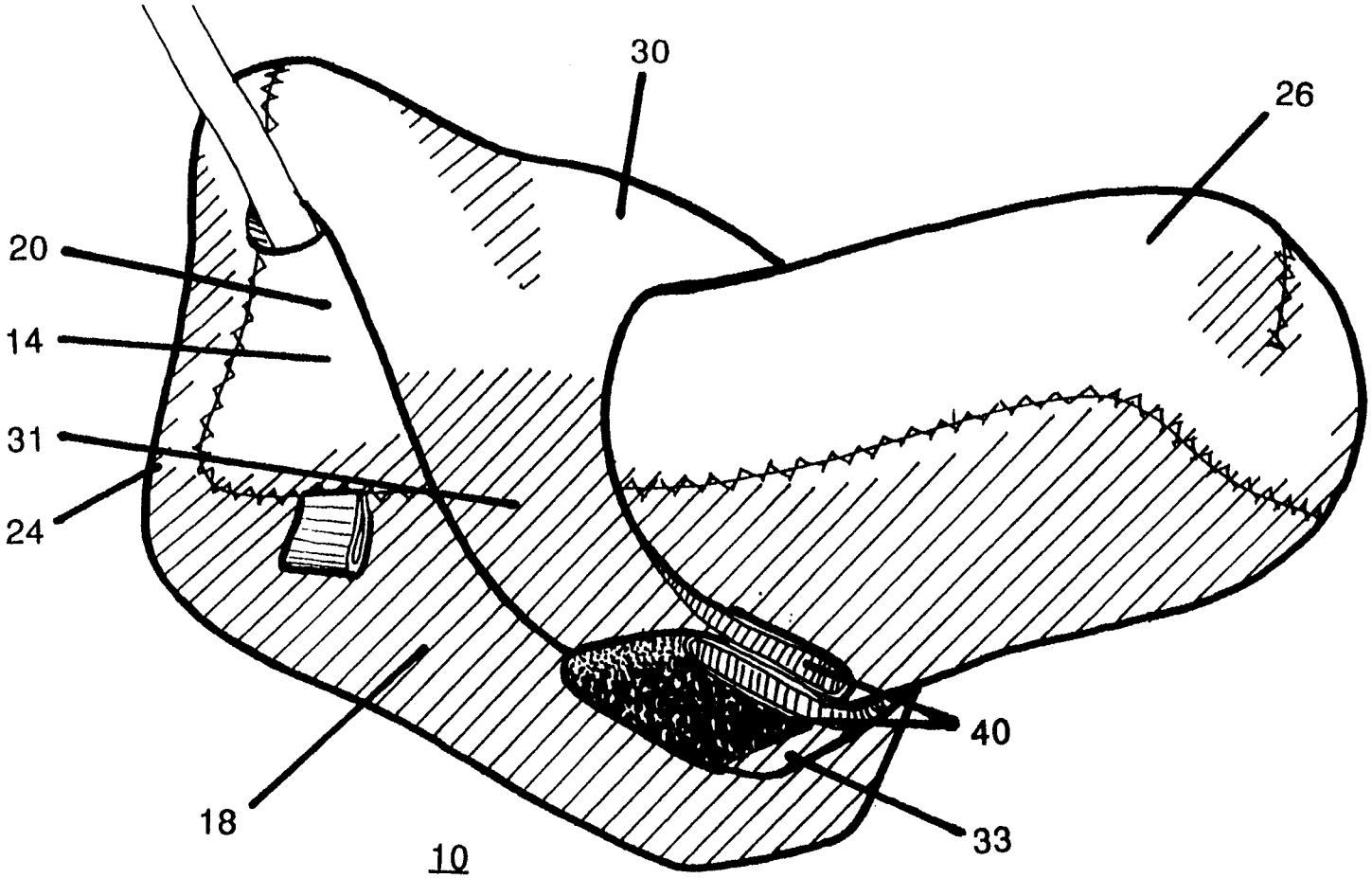
Figure 3A:
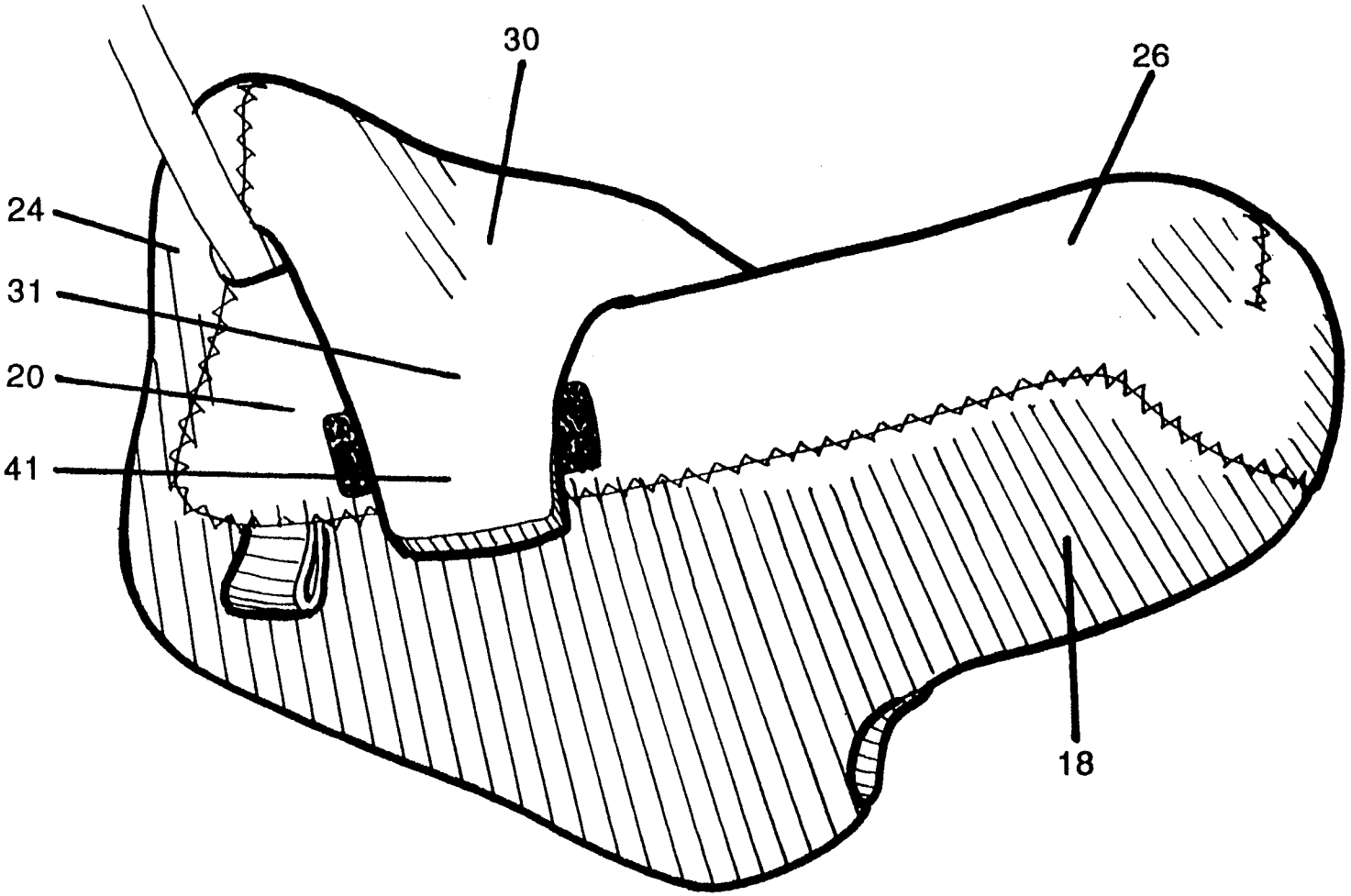
FIGS. 3A and 3B are perspective views of another embodiment of the case in accordance with the invention.
Figure 3B:
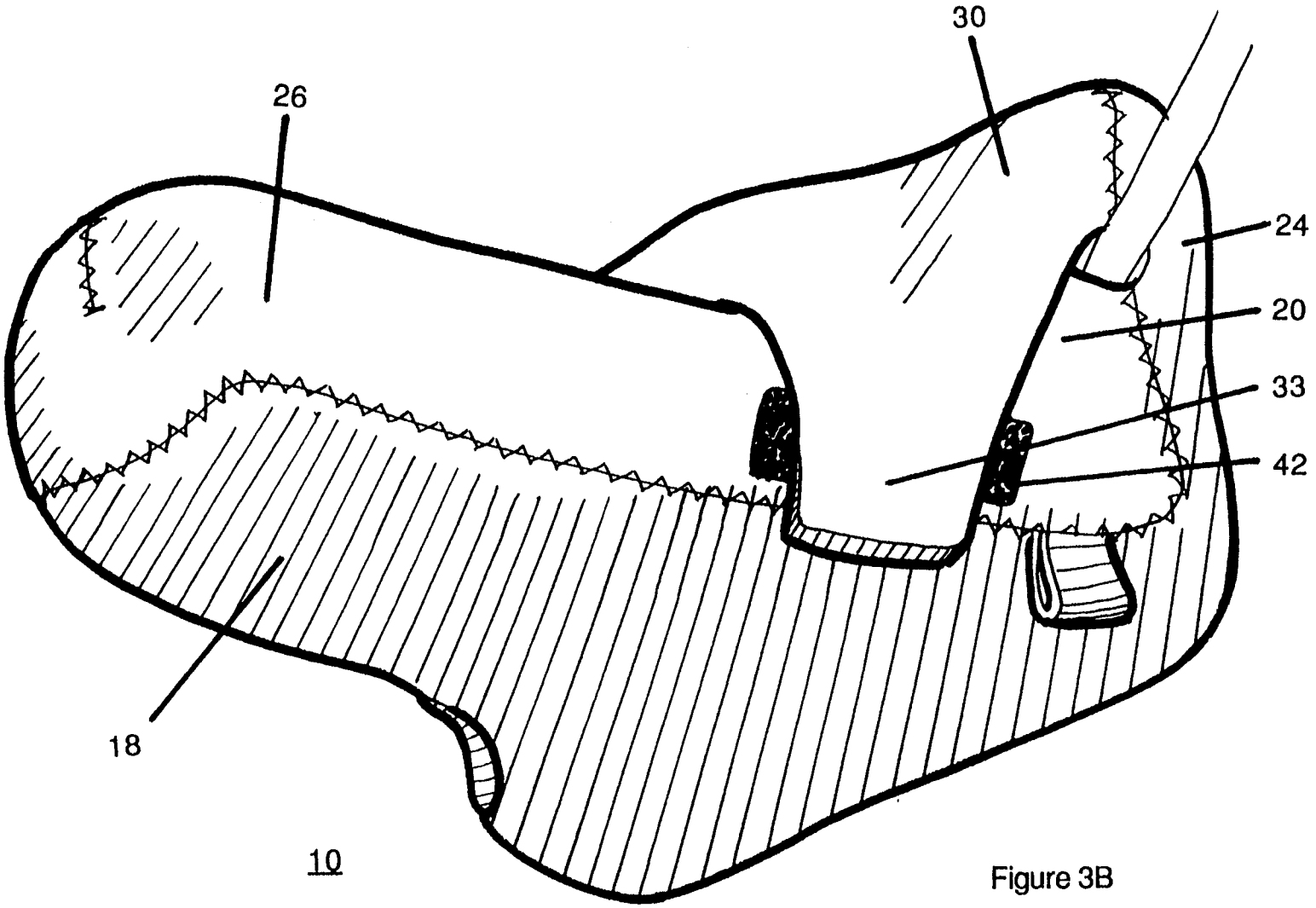

Cover 16 extends from the main housing 14 at the top of rear panel 22. Cover 16 contains top piece 30 attached to rear panel 22, and left 31 and right 33 flaps extending from top piece 30. Flaps 31 and 33 each contain potions of fastening device 40. As seen in FIG. 2B, the cover is maintained in the closed position by the extension of the flaps 31 and 33 under lenspiece 26 where they are held together by means of fastening device 40. In an alternate embodiment shown in FIGS. 3A and 3B, the cover is maintained in the closed position by the attachment of flap 31 to the lower left side of front 20 by means of fastening device 41, and also by the attachment of flap 33 to the lower right side of front 20 by means of a second fastening device 42. The fastening devices 40–42 may be "hook and loop" (Velcro®), snaps, buckles, clips, buttons or other similar devices.

Figure 4:
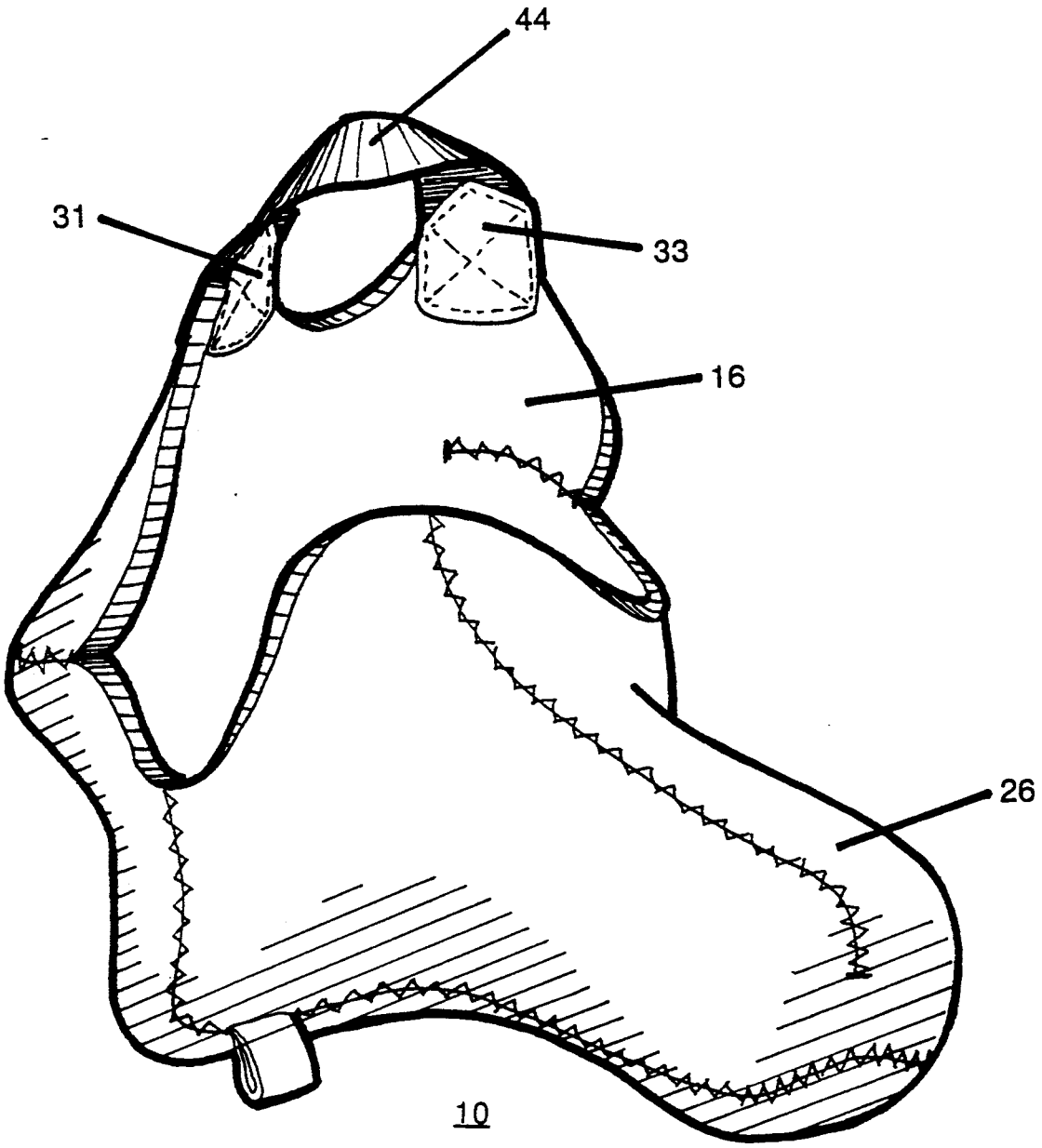
FIG. 4 is a perspective view of still another embodiment of the case in accordance with the invention.

In still another alternate embodiment shown in FIG. 4, the cover is maintained in the closed position by the attachment of flap 31 to flap 33 by a connecting elastic strip 44. Strip 44 is permanently attached to the two flaps, and closure is accomplished by inserting lenspiece 26 through the aperture created by strip 44 and flaps 31 and 33.

In the preferred embodiment of this invention, body 14 and cover 16 are made of resilient, deformable, waterproof material, most preferably both are made of the same material. Examples of such materials are elastic polymers including neoprene rubber, Hypolon®, or neoprene rubber with laminated nylon on one or both sides.

The resilient, deformable nature of the material and the unitary construction of the case permits the case to be easily reversible or invertible, so that pocket 32 becomes the outer surface of body housing 14 and vice versa. Reversibility permits the user to change at will the color, texture, or other qualifies of the outer surface of the case.

It will be seen that for the embodiment of this invention shown in FIGS. 2A, 2B and 4, the "latching" function works equally well in the normal and inverted states. The deformable nature also permits the body to deform into a variety of shapes, so that the case is of the "one size fits all" variety.

The camera case of this invention is capable of holding a camera with a lens of any size. However, the case is particularly suitable for cameras having lenses at least 4.5 inches long. Cameras with lenses of this size are not well suited for the aperture-closing cases as described in U.S. Pat. No. 5,101,974.

At this point it may be noted that as another feature, this invention consists of a clipping device 36 attached to pocket 32, as shown in FIG. 1. This clipping device is capable of attaching to the camera in one of the upper camera body comers where a camera strap usually attaches, or it may attach to the camera strap itself. When clipping device 36 is attached to the camera, it ensures that case 10 remains attached to the camera after the camera has been removed from the case. If the camera user is holding the camera by means of a camera strap, then the clipping device further ensures that the user does not lose the case.

The invention may further consist of another clipping device 38 attached to the outer surface of body 14, as shown in FIG. 2A. This second clipping device serves the same function as clipping device 36 when case 10 is inverted. In a preferred embodiment, the two clipping devices consist of two fabric loops and a removable metal clip that may be transferred to either loop depending on the configuration of the case.

While particular embodiments of this invention have been shown in the drawings and described above, it will be apparent that many changes may be made in the form, arrangement and positioning of the various elements of the combination. Therefore it should be understood that preferred embodiments of this invention disclosed herein are intended to be illustrative only and not intended to limit the scope of the invention.

I claim:

1. A camera protective case of unitary construction comprising:

a flexible deformable hollow body having an inner and outer surface and having contours corresponding generally to the contours of a camera to be carded therein, the body having an open end adapted to receive the camera therein, the body including a front portion having a hollow lenspiece adapted to receive and cover a lens of the camera when the camera is received in the body, the body including a rear portion opposite from the lenspiece; and a flexible deformable cover extending from the rear portion, and capable of moving from a closed position in which the cover closes the open end and overlaps the front portion to an open position in which the cover opens the open end and uncovers the front portion, the cover including a top piece having left and right sides and two flaps extending from the left and right sides, the two flaps including a fastening device mounted thereon capable of maintaining the cover in a closed position, wherein the fastening device links the two flaps together under the lenspiece.

2. The camera protective case of claim 1 wherein the fastening device is selected frown the group consisting of Velcro, buckles, snaps, clips, hooks and buttons.

3. The camera protective case of claim 1 wherein the body is deformable to permit the case to be inverted so that the outer surface of the case becomes the inner surface and the inner surface becomes the outer surface.

4. The camera protective case of claim 3 wherein the cover is of the same material as the body.

5. The camera protective case of claim 4 wherein the material is an elastic polymer.

6. The camera protective case of claim 5 wherein the elastic polymer is selected from the group consisting of neoprene and Hypolon.

7. The camera protective case of claim 6 further comprising a protective layer of laminated nylon on at least one surface of the case.

8. The camera protective case of claim 3 further comprising a first clipping device attached to the body in the pocket and capable of attaching to the camera.

9. The camera protective case of claim 8 further comprising a second clipping device attached to the body on the outer surface and capable of attaching to the camera when the case is inverted.

10. The camera protective case of claim 1 wherein the fastening device is an elastic strip permanently attached to the two flaps thereby forming an aperture for receiving the lenspiece and camera lens therethrough.

* * * * *